United States Patent [19]

Mackles et al.

[11] Patent Number: 4,730,751

[45] Date of Patent: Mar. 15, 1988

[54] SQUEEZE BOTTLE POWDER DISPENSER

[76] Inventors: Leonard Mackles, 311 E. 23d St., New York, N.Y. 10010; Leonard Chavkin, R.D.I. Box 90, Bloomsbury, N.J. 08804

[21] Appl. No.: 864,564

[22] Filed: May 16, 1986

[51] Int. Cl.[4] ..... B67D 5/58

[52] U.S. Cl. ..... 222/189; 222/211; 239/327

[58] Field of Search ..... 222/211, 464, 190, 189, 222/206, 215, 630; 239/327, 334, 342

[56] References Cited

U.S. PATENT DOCUMENTS

| | | | |
|---|---|---|---|
| 1,548,379 | 8/1925 | Parsons et al. | 222/189 |
| 2,551,676 | 6/1958 | Hoffman | 222/148 |
| 2,840,277 | 8/1960 | Bach | 222/193 |
| 2,876,782 | 3/1959 | Hudgens | 222/211 |
| 3,132,807 | 5/1964 | Nadai | 222/211 |
| 3,563,417 | 2/1971 | Jordan | 222/189 |
| 4,044,923 | 8/1977 | Gardner | 222/211 |
| 4,122,979 | 10/1978 | Laauwe | 222/211 |
| 4,142,652 | 3/1979 | Platt | 222/189 |
| 4,301,799 | 11/1981 | Pope, Jr. et al. | 222/189 |
| 4,530,466 | 7/1985 | Rounkles et al. | 222/211 |

*Primary Examiner*—Joseph J. Rolla
*Assistant Examiner*—Kenneth Noland
*Attorney, Agent, or Firm*—Watson, Cole, Grindle & Watson

[57] ABSTRACT

A squeeze bottle powder dispenser has a plug fixedly secured in the bottle neck, air passages in the plug communicating with a mixing/spin chamber, a discharge orifice leading from the chamber, and a dip tube supported by the plug. A multi-cellular foam pad encases the lower end of the dip tube for effecting smooth and uniform movement, without clogging, of powder through the tube. Another multi-cellular foam pad may overlie the air passages through which powder is dispensed, without clogging, during inverted spray.

5 Claims, 9 Drawing Figures

12
25a
14
25
11
10

11
10

15
16
12
13
11
25a
14
10
P
25
15

25
25a 16
12

8
19
17
23
12
15
7
7
16
24
21
8

13
12
6
6

15
16
13
21
12
17
18
22
14

23
15
16
24
13
12
19
21
18
22
14

SQUEEZE BOTTLE POWDER DISPENSER

BACKGROUND OF THE INVENTION

This invention relates generally to a squeeze bottle powder dispenser, and more particularly to such a dispenser having a dip tube through which the powder is discharged upon alternately squeezing and releasing the squeeze bottle, the dip tube having at its inner end an attached pad of open cellular foam material for moderating the flow of powder to effect a smooth and uniform flow of powder through the tube without clogging or agglomeration during dispensing.

It is frequently necessary or desirable to administer or apply active medicinal agents in powder form. Some medicinals are so unstable (e.g. antibiotics) that dry powder sprays are the best way to apply them to the skin especially onto wet body surfaces or to administer them intranasally or by oral inhalation into the lungs or into other body cavities.

In some cases it is most desirable to administer the active agent in powder form for aesthetic reasons as, for example, in the case of underarm antiperspirants. The active antiperspirant chemicals are all powders and the other ingredients used to formulate the typical product forms reduce the activity of the antiperspirants and leave some objectionable residues in the underarm areas. The history of product developments in the field of antiperspirants suggests that dryness is the key product attribute most appreciated by consumers. Yet the existing product forms, roll-ons, aerosols and sticks, leave some significant residue other than the active agent on the skin of the underarm. Consumers universally object to these residues considering their presence in contrast to the desired dryness they hope to achieve.

Additionally, powders administered as sprays intranasally or by oral inhalation provide a preferred route for the systemic action of some medicinal agents. Many drugs can enter the blood stream rapidly through the oral and nasal mucosa and proceed rapidly to the site of their action in the body. In this manner the destructive effect of the gastrointestinal tract upon the drug's integrity is avoided and also avoided is the irritant effect of many drugs upon the stomach and intestines.

It has therefore been long recognized that powder sprays have unique advantages. Yet the devices for the administration of powders developed in the past have been cumbersome, complicated and expensive, inconvenient or unpleasant to use. For example, U.S. Pat. No. 2,840,277 discloses a squeeze bottle powder dispenser having a dip tube through which the powder is discharged upon squeezing the bottle. Other powder dispensers, known as insufflators, provide a squeeze bulb for directing air under pressure into a powder container creating an air turbulence which mixes air into the powder causing the mixture to be discharged through a discharge spout. However, these devices are incapable of delivering a uniform spray of powder so that consistent dosage can be obtained. These disadvantages have therefore limited the use of powder sprays as a means of delivering active ingredients to the human body.

SUMMARY OF THE INVENTION

It is therefore an object of the present invention to provide a squeeze bottle powder dispenser operable in both upright and inverted positions and capable of discharging a fine uniform powder spray, as for example, in the application of powders to skin surfaces or in the introduction of powders into body cavities.

Another object of the invention is to provide such a powder dispenser as having a dip tube through which the powder is discharged, and an air passage for mixing air with the powder during dispensing. The inner end of the tube is screened for moderating the flow of powder through the tube and protecting the inner end of the tube from powder packing during storage and non-use, thus achieving a uniform discharge flow during upright dispensing. This screening or shielding is effected by encasing the dip tube inner end in a multi-cellular open cell foam pad. The air passage may likewise be covered by the foam pad to facilitate dispensing in an inverted position in which the air passage serves as a product passage and the dip tube as an air passage.

A further object of this invention is to provide such a powder dispenser in which a plug is fixedly secured within the bottle neck, the plug having a mixing chamber, a discharge orifice leading from the chamber and a pair of opposed air passages leading into the chamber from inside the bottle. The dip tube is supported from the plug. The mixing chamber defines a central circular spin chamber overlying the product dip tube opening and slightly offset relative to the discharge orifice. A pair of lateral slots extend between the spin chamber and the opposed air passages.

A still further object of the present invention is to provide such a dispenser wherein the plug has a central cylindrical wall into which the dip tube extends, the cylindrical wall having axial open grooves defining the air/product passages together with the tube.

Other objects, advantages and novel features of the invention will become more apparent from the following detailed description of the invention when taken in conjunction with the accompanying drawings.

DETAILED DESCRIPTION OF THE INVENTION

Figure 5:
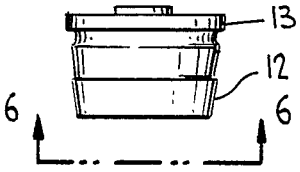

Turning now to the drawings wherein like reference characters refer to like and corresponding parts throughout the several views, a bottle or container 10 of free flowing powder has a resiliently flexible wall or wall portion which may be alternately squeezed or indented to expel a portion of its contents and then released. Such a container is commonly known as a "squeeze bottle." The bottle contains a quantity of free flowing powder P, and has an externally threaded neck portion integrally molded therewith. A plug 12 is press fitted within the bottle neck for tight engagement therein as its external ferrules (FIG. 5) tightly grip the inner surface of the bottle neck. The plug has an outer, slightly enlarged cap 13 which engages the outer rim of the bottle neck, and the plug supports a hollow dip tube 14 at one end, the tube extending into the bottle as shown in FIG. 3 with its opposite end lying adjacent bottom wall 15 of the bottle.

Figure 6:
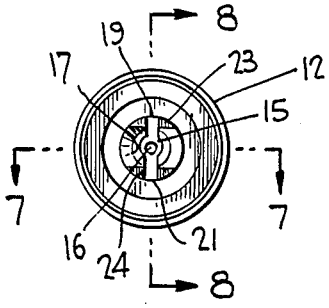
FIG. 6 is a bottom plan view of the plug taken substantially along the line 6—6 of FIG. 5.
Figure 7:
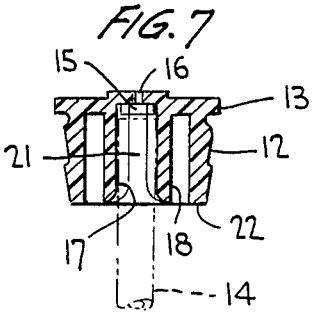
FIGS. 7 and 8 are cross-sectional views taken substantially along the lines 7—7 and 8—8, respectively, of FIG. 6.
Figure 8:
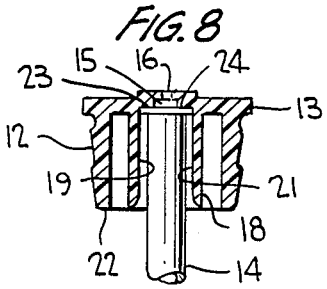

The plug is formed as having a mixing chamber 15 and a discharge orifice 16 leading from the chamber. The plug further has a central cylindrical internal wall 17, shown in detail in FIGS. 6–8. This cylindrical wall may be defined by a depending central sleeve 18 spaced inwardly of the outer wall of the plug for both material saving purposes during molding and for allowing the plug wall to more easily yield when press fitted into the bottle neck. Wall 17 has a pair of opposed axial grooves 19,21 formed therein extending from the mixing chamber to lower end 22 of the plug. The upper end of the dip tube is press fitted into cylindrical wall 17, and axial grooves 19,21 form a pair of opposed air passages with the inserted tube end, as shown in FIG. 8.

Mixing chamber 15 is formed in cap 13 in the form of a circular spin chamber (FIG. 6) overlying the open upper end of the dip tube and being slightly offset from the discharge orifice. And, formed at the underside of cap 13 are a pair of radial grooves 23,24 interconnecting the spin chamber respectively with the air passages formed by the axial grooves. The upper free end of the dip tube bears against the underside of cap 13.

Figure 1:
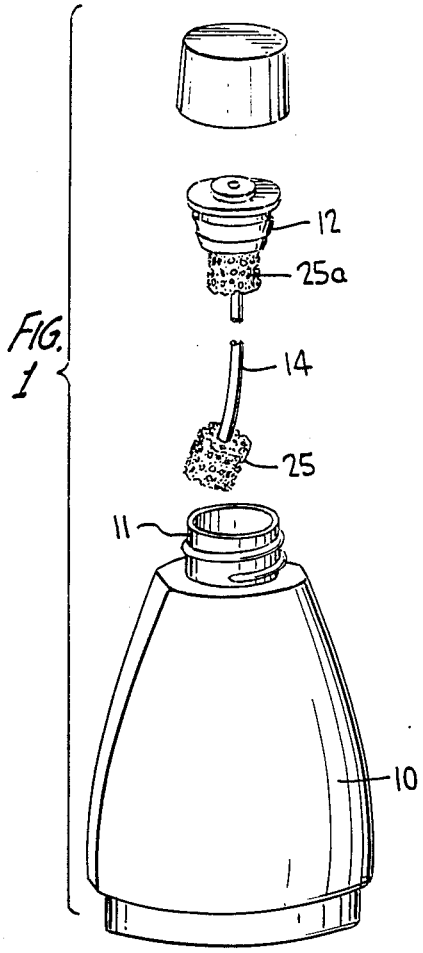
FIG. 1 is an expanded, perspective view of the squeeze bottle powder dispenser according to the invention.
Figure 3:
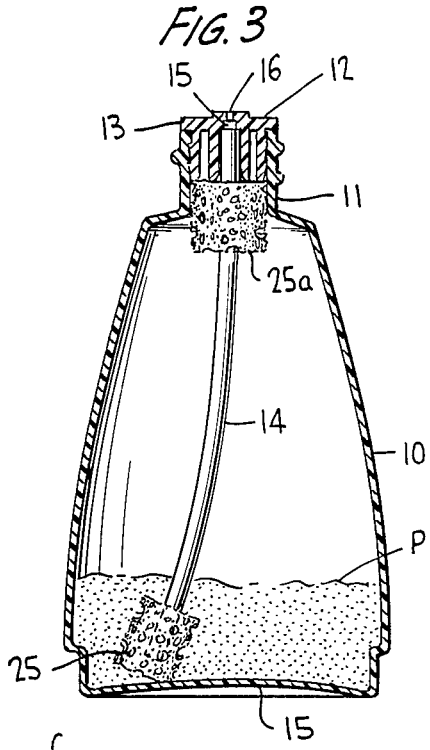
FIG. 3 is a slightly enlarged cross-sectional view of the squeeze bottle and inserted plug supporting the dip tube.

A multi-cellular open cell foam pad 25 is affixed to the lower end of the dip tube, as shown in FIGS. 1 and 3, such that a portion of the pad overlies the tube opening, and the entirety of the pad functions as a screen or porous shield presenting a tortuous path which serves to moderate the flow of powder through the dip tube. Thus, the movement of powder up the dip tube is smooth and uniform and proceeds without clogging or agglomeration which may be caused during periods of non-use of the dispenser, and/or due to the admission of moisture within the bottle.

Figure 2:
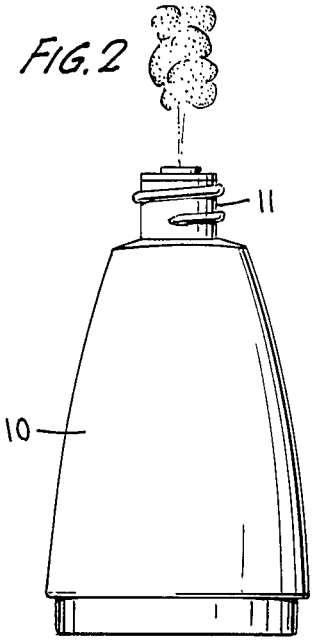
FIG. 2 is a perspective view of the present squeeze bottle with the cap removed, showing the manner of powder dispensing.

The powder is dispensed by applying external force to a wall portion or portions of the squeeze bottle, such that air within the bottle above the powder is pressurized, and exerts pressure against the powder within the bottle forcing it through the open cellular pad and up through the dip tube, as shown in FIG. 2 in an upright position. At the same time, the presurized air within the bottle is forced through air passages 19,21 and inwardly along radial grooves 23,24 so as to mix with the incoming powder within spin chamber 15 prior to discharge through orifice 16. Because of the offsetting relationship between the spin chamber and the discharge orifice, the radial path of inward travel of the air along grooves 23,24 is uneven so as to thereby cause a swirl within chamber 15 and an enhanced finely divided powder spray as it is discharged.

Figure 9:
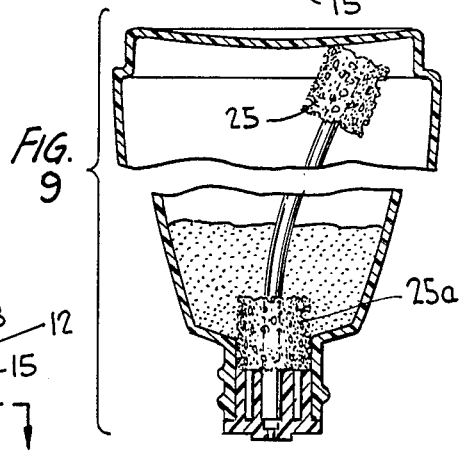
FIG. 9 is a view similar to FIG. 3 showing an inverted spray position.
Figure 4:
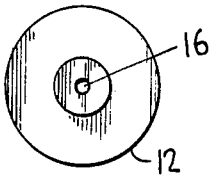
FIGS. 4 and 5 are top plan and side elevational views, respectively, of the plug fitted in the end of the bottle neck.

Another foam pad **25*a* may be provided within the bottle neck and covering passages 19, 21. Pad 25*a* may be simply impaled over the dip tube and forced into the neck opening for retaining it in place. Thus, when dispensing in the inverted position of FIG. 9, the dip tube becomes the air passage and the product flows through passages 19, 21. Otherwise, dispensing is effected in the same manner as described with reference to FIG. 3**. With the provision of the foam pad, the flow of powder into and through the dip tube is so uniform that dosages are reproducible with each squeeze of the bottle, as enhanced by the slight swirl effected by the spin chamber. The amount of powder delivered with each squeeze is controlled by the inner diameter of the dip tube which can vary between 0.02 inch to 0.09 inch. The foam pad serves to protect the lower end of the dip tube from powder packing during storage and periods of non-use. The pad thus acts in the manner of a sieve valve. The open cell foam pad may have from 10 to 100 cell openings per linear inch, and the foam cell diameter can control the particle size of the powders it allows to enter the dip tube. The multi-cellular open foam may be made of polyurethane polyvinyl chloride or natural latex. Other materials which are multicellular can also be used such sintered plastics, sintered metals, cotton, etc.

To assure a uniform powder spray with reliable metered delivery, the powders should have fine free flowing characteristics similar to liquids. Even fine powders rarely flow with ease. It is known that certain material when added to powders will affect their flow characteristics either by a lubricating effect or by eliminating static charges. It has been found possible to fine tune these systems so as to obtain a powder which has the flow characteristics of a liquid. Certain chemicals, such as fumed silicon dioxide, fumed aluminum oxide and tri-calcium phosphate can be used to modify powder flow. Their effect is such that when they are mixed with certain powders in small amounts, for example 1% or less by weight, they can cause the powder to undulate when shaken or disturbed. For example, an active antiperspirant powder, when mixed with 1% fumed silicon dioxide by weight flows like a liquid. Similarly, 1% tri-calcium phosphate by weight will cause corn starch to behave like a liquid, and 1% fumed aluminum oxide by weight mixed with talc will have the same effect.

From the foregoing, it can be seen that a simple and economical, yet highly effective powder dispenser is provided in which an open cellular foam pad attached to the inner end of the dip tube so as to encase the inner end effects uniform powder flow during dispensing upon bottle squeezing in both substantially upright and inverted positions. The powder is forced through its passage in a smooth and uniform movement and proceeds without clogging as the foam pad not only protects the product passage inlet from powder packing during storage and non-use, but filters any agglomerated powder mass in the process of being forced into such inlet. And, the axial grooves formed in the cylindrical wall of the plug into which the upper end of the dip tube is inserted form air passages (or product passages when inverted) without the need to provide separate ducts which only increases the cost of production. Thus, only a single passageway need be formed by the inner wall of the sleeve of the plug into which an end of the dip tube is inserted, the axial grooves forming the flow passages together with the tube.

The different lengths of travel of the air (or product) passing inwardly through the radial grooves into the circular spin chamber create a slight swirling movement of the air as it mixes with the incoming smoothly flowing powder (or air) from the dip tube, such that a fine powder mist is discharged through the orifice.

Obviously, many other modifications and variations of the present invention are made possible in the light of the above teachings. It is therefore to be understood that within the scope of the appended claims the invention may be practiced otherwise than as specifically described.

What is claimed is:

1. In a dry powder dispenser capable of being operated in at least a substantially upright position, comprising a squeeze container having at least a resiliently flexible wall portion and a connected neck portion, a plug fixedly secured within said neck and having a mixing chamber, a discharge orifice leading from said chamber, and at least one first passage extending inwardly from said chamber to the interior of the container, a hollow dip tube supported at one end within said plug and extending to said chamber, said dip tube defining a second passage to said chamber from an opposite end of said tube lying adjacent a wall of the container opposite said neck portion, said second passage at said opposite end of said tube defining an inlet opening, whereby upon application of external pressure to the container the air therewithin forces powder through said second passage and is mixed with air entering said chamber from said first passage before being discharged through said orifice when dispensing in said subtantially upright position of the container, the improvement wherein a first pad of open cellular foam material is attached to said opposite end of said tube overlying said inlet opening to said second passage for moderating the flow of powder entering said inlet opening to effect smooth and uniform powder flow through said second passage without clogging during dispensing, said pad being submerged in the dry powder during operation of the dispenser in said upright position, and said pad comprising a sieve having from 10 to 100 cell openings per linear inch presenting a tortuous path for breaking up agglomerated powder particles and for allowing only unpacked powder particles to enter said inlet opening solely upon application of the external pressure to the container causing air within the container to force the powder through the tortuous path and into said second passage.

2. The dispenser according to claim 1, wherein a second pad of open cellular foam material overlies the opening to said first passage for moderating the flow of powder to effect a smooth and uniform powder flow without clogging during dispensing in a substantially inverted position of the container said dip tube extending completely through said second pad such that said second pad is spaced from said chamber a distance equal to the length of said first passage, and said second pad comprising a sieve having from 10 to 100 cell openings per linear inch breaking up agglomerated powder particles and for allowing only unpacked powder particles to enter said first passage openings.

3. The dispenser according to claim 1, wherein said plug has another first passage, lying opposite said one passage, extending inwardly from said chamber to the interior of the container, said chamber comprising a central circular spin chamber overlying said second passage and offset relative to said discharge orifice, and a pair of lateral slots extending respectively between said spin chamber and said first passages, whereby the powder is finely divided upon discharge.

4. The dispenser according to claim 1, wherein said plug has a central cylindrical wall in engagement with said one end of said dip tube, said wall having an axial open groove defining said one first passage together with said one end of said tube.

5. The dispenser according to claim 1, wherein said plug has a central cylindrical wall in engagement with said one end of said dip tube, said wall having a pair of axial open grooves defining said first passages together with said one end of said tube.

* * * * *